US007920097B2

(12) United States Patent
Quintero Illera et al.

(10) Patent No.: US 7,920,097 B2
(45) Date of Patent: Apr. 5, 2011

(54) MULTIBAND ANTENNA

(75) Inventors: Ramiro Quintero Illera, Barcelona (ES); Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 95 days.

(21) Appl. No.: 12/229,483

(22) Filed: Aug. 22, 2008

(65) Prior Publication Data

US 2009/0066582 A1 Mar. 12, 2009

Related U.S. Application Data

(63) Continuation of application No. 11/702,791, filed on Feb. 6, 2007, now Pat. No. 7,439,923, which is a continuation of application No. 10/823,257, filed on Apr. 13, 2004, now Pat. No. 7,215,287, which is a continuation of application No. PCT/EP01/11912, filed on Oct. 16, 2001.

(51) Int. Cl.
*H01Q 1/24* (2006.01)

(52) U.S. Cl. ..... 343/702; 343/700 MS; 343/895

(58) Field of Classification Search ..... 343/700 MS, 343/702, 800, 846, 895
See application file for complete search history.

(56) References Cited

U.S. PATENT DOCUMENTS

| | | | |
|---|---|---|---|
| 3,521,284 | A | 7/1970 | Shelton, Jr. et al. |
| 3,599,214 | A | 8/1971 | Altmayer |
| 3,622,890 | A | 11/1971 | Fujimoto et al. |
| 3,683,376 | A | 8/1972 | Pronovost |
| 3,818,490 | A | 6/1974 | Leahy |
| 3,967,276 | A | 6/1976 | Goubau |
| 3,969,730 | A | 7/1976 | Fuchser |
| 4,024,542 | A | 5/1977 | Ikawa et al. |
| 4,131,893 | A | 12/1978 | Munson et al. |
| 4,141,016 | A | 2/1979 | Nelson |
| 4,471,358 | A | 9/1984 | Glasser |
| 4,471,493 | A | 9/1984 | Schober |
| 4,504,834 | A | 3/1985 | Garay et al. |
| 4,543,581 | A | 9/1985 | Nemet |
| 4,571,595 | A | 2/1986 | Phillips et al. |
| 4,584,709 | A | 4/1986 | Kneisel et al. |
| 4,590,614 | A | 5/1986 | Erat |
| 4,623,894 | A | 11/1986 | Lee et al. |
| 4,673,948 | A | 6/1987 | Kuo |
| 4,730,195 | A | 3/1988 | Phillips et al. |
| 4,839,660 | A | 6/1989 | Hadzoglou |
| 4,843,468 | A | 6/1989 | Drewery |
| 4,847,629 | A | 7/1989 | Shimazaki |

(Continued)

FOREIGN PATENT DOCUMENTS

CA 2416437 A1 1/2002

(Continued)

OTHER PUBLICATIONS

Jani Ollikaninen et al., "Internal Dual-Band Patch Antenna for Mobile Phones", European Space Agency, Millennium Conference on Antennas & Propagation, Apr. 9-14, 2000.

(Continued)

*Primary Examiner* — Tho G Phan
(74) *Attorney, Agent, or Firm* — Winstead PC

(57) ABSTRACT

A multiband antenna includes at least two polygons. The at least two polygons are spaced by means of a non-straight gap shaped as a space-filling curve, in such a way that the whole gap length is increased yet keeping its size and the same overall antenna size allowing for an effective tuning of frequency bands of the antenna.

50 Claims, 7 Drawing Sheets

U.S. PATENT DOCUMENTS 4,849,766 A 7/1989 Inaba et al.
4,857,939 A 8/1989 Shimazaki
4,890,114 A 12/1989 Egashira
4,894,663 A 1/1990 Urbish et al.
4,907,011 A 3/1990 Kuo
4,912,481 A 3/1990 Mace et al.
4,975,711 A 12/1990 Lee
5,030,963 A 7/1991 Tadama
5,138,328 A 8/1992 Zibrik et al.
5,168,472 A 12/1992 Lockwood
5,172,084 A 12/1992 Fiedzuiszko et al.
5,200,756 A 4/1993 Feller
5,214,434 A 5/1993 Hsu
5,218,370 A 6/1993 Blaese
5,227,804 A 7/1993 Oda
5,227,808 A 7/1993 Davis
5,245,350 A 9/1993 Sroka
5,248,988 A 9/1993 Makino
5,255,002 A 10/1993 Day
5,257,032 A 10/1993 Diamond et al.
5,347,291 A 9/1994 Moore
5,355,144 A 10/1994 Walton et al.
5,355,318 A 10/1994 Dionnet et al.
5,373,300 A 12/1994 Jenness et al.
5,402,134 A 3/1995 Miller et al.
5,420,599 A 5/1995 Erkocevic
5,422,651 A 6/1995 Chang
5,451,965 A 9/1995 Matsumoto
5,451,968 A 9/1995 Emery
5,453,751 A 9/1995 Tsukamoto et al.
5,457,469 A 10/1995 Diamond et al.
5,471,224 A 11/1995 Barkeshli
5,493,702 A 2/1996 Crowley et al.
5,495,261 A 2/1996 Baker et al.
5,534,877 A 7/1996 Sorbello et al.
5,537,367 A 7/1996 Lockwood et al.
5,684,672 A 11/1997 Karidis et al.
5,712,640 A 1/1998 Andou et al.
5,767,811 A 6/1998 Mandai et al.
5,798,688 A 8/1998 Schofield
5,821,907 A 10/1998 Zhu et al.
5,841,403 A 11/1998 West
5,867,126 A 2/1999 Kawahata et al.
5,870,066 A 2/1999 Asakura et al.
5,872,546 A 2/1999 Ihara et al.
5,898,404 A 4/1999 Jou
5,903,240 A 5/1999 Kawahata et al.
5,926,141 A 7/1999 Lindenmeier et al.
5,943,020 A 8/1999 Liebendoerfer et al.
5,966,097 A 10/1999 Fukasawa et al.
5,966,098 A 10/1999 Qi et al.
5,973,651 A 10/1999 Suesada et al.
5,986,610 A 11/1999 Miron
5,990,838 A 11/1999 Burns et al.
6,002,367 A 12/1999 Engblom et al.
6,028,568 A 2/2000 Asakura et al.
6,031,499 A 2/2000 Dichter
6,031,505 A 2/2000 Qi et al.
6,078,294 A 6/2000 Mitarai
6,091,365 A 7/2000 Derneryd et al.
6,097,345 A 8/2000 Walton
6,104,349 A 8/2000 Cohen
6,127,977 A 10/2000 Cohen
6,131,042 A 10/2000 Lee et al.
6,140,969 A 10/2000 Lindenmeier et al.
6,140,975 A 10/2000 Cohen
6,160,513 A 12/2000 Davidson et al.
6,172,618 B1 1/2001 Hakozaki et al.
6,211,824 B1 4/2001 Holden et al.
6,218,992 B1 4/2001 Sadler et al.
6,236,372 B1 5/2001 Lindenmeier et al.
6,252,554 B1 6/2001 Isohatala et al.
6,266,023 B1 7/2001 Nagy et al.
6,281,846 B1 8/2001 Puente Baliarda et al.
6,307,511 B1 10/2001 Ying et al.
6,329,951 B1 12/2001 Wen et al.
6,329,954 B1 12/2001 Fuchs et al.
6,343,208 B1 1/2002 Ying et al.
6,366,243 B1 4/2002 Isohatala et al.
6,367,939 B1 4/2002 Carter et al.
6,407,710 B2 6/2002 Keilen et al.
6,417,810 B1 7/2002 Huels et al.
6,431,712 B1 8/2002 Turnbull
6,445,352 B1 9/2002 Cohen
6,452,549 B1 9/2002 Lo
6,452,551 B1 9/2002 Chen et al.
6,452,553 B1 9/2002 Cohen
6,466,176 B1 10/2002 Maoz
6,476,766 B1 11/2002 Cohen
6,476,767 B2 11/2002 Aoyama et al.
6,496,148 B2 12/2002 Ngounou Kouam
6,525,691 B2 2/2003 Varadan et al.
6,545,640 B1 4/2003 Herve et al.
6,552,690 B2 4/2003 Veerasamy
6,606,062 B2 8/2003 Kouam et al.
6,642,898 B2 11/2003 Eason
6,664,932 B2 12/2003 Sabet et al.
2002/0000940 A1 1/2002 Moren et al.
2002/0000942 A1 1/2002 Duroux
2002/0003499 A1 1/2002 Kouam et al.
2002/0036594 A1 3/2002 Gyenes
2002/0105468 A1 8/2002 Tessier et al.
2002/0109633 A1 8/2002 Ow et al.
2002/0126054 A1 9/2002 Fuerst et al.
2002/0126055 A1 9/2002 Lindenmeier et al.
2002/0175866 A1 11/2002 Gram
2002/0175879 A1 11/2002 Sabet et al.
2002/0196191 A1 12/2002 Ngounou Kouam
2004/0217916 A1 11/2004 Quintero Illera et al.

FOREIGN PATENT DOCUMENTS

DE 3337941 5/1985
EP 0096847 12/1983
EP 0897813 6/1988
EP 0358090 8/1989
EP 0543645 5/1993
EP 0571124 11/1993
EP 0688040 12/1995
EP 0765001 3/1997
EP 0814536 12/1997
EP 0871238 10/1998
EP 0892459 1/1999
EP 0929121 7/1999
EP 0932219 7/1999
EP 0969375 1/2000
EP 0986130 3/2000
EP 0942488 4/2000
EP 0997974 5/2000
EP 1018777 7/2000
EP 1018779 7/2000
EP 1071161 1/2001
EP 1079442 2/2001
EP 1083624 3/2001
EP 1094545 4/2001
EP 1096602 5/2001
EP 1128466 8/2001
EP 1148581 10/2001
EP 1198027 4/2002
EP 1237224 9/2002
EP 1267438 12/2002
ES 2112163 3/1998
ES 2142280 5/1998
FR 2543744 10/1984
FR 2704359 10/1994
GB 2215136 9/1989
GB 2330951 5/1999
GB 2355116 4/2001
JP 55147806 11/1980
JP 5007109 1/1993
JP 5129816 5/1993
JP 5267916 10/1993
JP 5347507 12/1993
JP 6204908 7/1994
JP 10209744 8/1998
WO 9511530 4/1995
WO 9627219 9/1996
WO 9629755 9/1996

| | | |
|---|---|---|
| WO | 9638881 | 12/1996 |
| WO | 9706578 | 2/1997 |
| WO | 9711507 | 3/1997 |
| WO | 9732355 | 9/1997 |
| WO | 9733338 | 9/1997 |
| WO | 9735360 | 9/1997 |
| WO | 9747054 | 12/1997 |
| WO | 9812771 | 3/1998 |
| WO | 9836469 | 8/1998 |
| WO | 9903166 | 1/1999 |
| WO | 9903167 | 1/1999 |
| WO | 9925042 | 5/1999 |
| WO | 9927608 | 6/1999 |
| WO | 9956345 | 11/1999 |
| WO | 0001028 | 1/2000 |
| WO | 0003453 | 1/2000 |
| WO | 0022695 | 4/2000 |
| WO | 0036700 | 6/2000 |
| WO | 0049680 | 8/2000 |
| WO | 0052784 | 9/2000 |
| WO | 0052787 | 9/2000 |
| WO | 0103238 | 1/2001 |
| WO | 0108257 | 2/2001 |
| WO | 0113464 | 2/2001 |
| WO | 0117064 | 3/2001 |
| WO | 0122528 | 3/2001 |
| WO | 0124314 | 4/2001 |
| WO | 0126182 | 4/2001 |
| WO | 0128035 | 4/2001 |
| WO | 0131739 | 5/2001 |
| WO | 0133665 | 5/2001 |
| WO | 0135491 | 5/2001 |
| WO | 0137369 | 5/2001 |
| WO | 0137370 | 5/2001 |
| WO | 0141252 | 6/2001 |
| WO | 0148861 | 7/2001 |
| WO | 0154225 | 7/2001 |
| WO | 0173890 | 10/2001 |
| WO | 0178192 | 10/2001 |
| WO | 0182410 | 11/2001 |
| WO | 0235646 | 5/2002 |
| WO | 02091518 | 11/2002 |
| WO | 02096166 | 11/2002 |
| WO | WO-02/095874 | 11/2002 |
| WO | WO-03/023900 | 3/2003 |

OTHER PUBLICATIONS

"Small Circulatory Polarized Microstrip Antennas" Wen-Shyang Chen, Department of Electronic Engineering, Cheng-Shiu Institute of Technology, 1999 IEEE.

Morishita, H. et al, Design concept of antennas for small mobile terminals and the future perspective, IEEE Antennas and propagation magazine, Oct. 2002.

Chen, H. et al, Dual-frequency rectangular microstrip antenna with double pi-shaped slots, Microwave and optical technology letters, May 5, 2001.

Lu, J., Single-feed dual-frequency triangular microstrip antenna with a pair of bent slots, Microwave and optical technology letters, Mar. 20, 2001.

Chen, H.; Lin, Y., Bandwidth enhancement of a microstrip antenna with embedded reactive loading, Microwave and optical technology letters, Jul. 20, 2000.

Mumbru, J. et al, Analysis and improvements of the J. Ollikainen, O. Kivekäs, A. Toropainen, P. Vainikainen, "Internal Dual-Band Patch Antenna for Mobile Phones, APS-2000 Millennium Conference on Antennas and Propagation", Davos, Switzerland, Apr. 2000, Fractus, dated Jul. 4, 2001, revised Dec. 9, 2005.

Kim, H. et al, Surface-mounted chip dielectric ceramic antenna for PCS phone, 5th International Symposium on Antennas, Propagation and EM Theory, 2000. Proceedings. ISAPE 2000, Aug. 15, 2000.

Wong , K. L. Dual frequency slotted rectangular microstrip antenna. Electronic Letters, vol. 34. No. 14, Jul. 1998.

Ali, M. et al., "A Triple-Band Internal Antenna for Mobile Hand-held Terminals," IEEE, pp. 32-35 (1992).

Romeu, Jordi et al., "A Three Dimensional Hilbert Antenna," IEEE, pp. 550-553 (2002).

Parker et al., "Microwaves, Antennas & Propagation," IEEE Proceedings H, pp. 19-22 (Feb. 1991).

Hansen, R.C., "Fundamental Limitations in Antennas," Proceedings of the IEEE, vol. 69, No. 2, pp. 170-182 (Feb. 1981).

Jaggard, Dwight L., "Fractal Electrodynamics and Modeling," Directions in Electromagnetic Wave Modeling, pp. 435-446 (1991).

Hohlfeld, Robert G. et al., "Self-Similarity and the Geometric Requirements for Frequency Independence in Antennae," Fractals, vol. 7, No. 1, pp. 79-84 (1999).

Samavati, Hirad, et al., "Fractal Capacitors," IEEE Journal of Solid-State Circuits, vol. 33, No. 12, pp. 2035-2041 (Dec. 1998).

Pribetich, P., et al., "Quasifractal Planar Microstrip Resonators for Microwave Circuits," Microwave and Optical Technology Letters, vol. 21, No. 6, pp. 433-436 (Jun. 20, 1999).

Zhang, Dawei, et al., "Narrowband Lumped-Element Microstrip Filters Using Capacitively-Loaded Inductors," IEEE MTT-S Microwave Symposium Digest, pp. 379-382 (May 16, 1995).

Gough, C.E., et al., "High Tc coplanar resonators for microwave applications and scientific studies," Physica C, NL,North-Holland Publishing, Amsterdam, vol. 282-287, No. 2001, pp. 395-398 (Aug. 1, 1997).

Radio Engineering Reference—Book by H. Meinke and F.V. Gundlah, vol. 1, Radio components. Circuits with lumped parameters. Transmission lines. Wave-guides. Resonators. Arrays. Radio waves propagation, States Energy Publishing House, Moscow, with English translation (1961) [4 pp.].

V.A. Volgov, "Parts and Units of Radio Electronic Equipment (Design & Computation)," Energiya, Moscow, with English translation (1967) [4 pp.].

Puente, C., et al., "Multiband properties of a fractal tree antenna generated by electrochemical deposition," Electronics Letters, IEE Stevenage, GB, vol. 32, No. 25, pp. 2298-2299 (Dec. 5, 1996).

Puente, C., et al., "Small but long Koch fractal monopole," Electronics Letters, IEE Stevenage, GB, vol. 34, No. 1, pp. 9-10 (Jan. 8, 1998).

Puente Baliarda, Carles, et al., "The Koch Monopole: A Small Fractal Antenna," IEEE Transactions on Antennas and Propagation, New York, US. vol. 48, No. 11, pp. 1773-1781 (Nov. 1, 2000).

Cohen, Nathan, "Fractal Antenna Applications in Wireless Telecommunications," Electronics Industries Forum of New England, 1997. Professional Program Proceedings Boston, MA US, May 6-8, 1997, New York, NY US, IEEE, US pp. 43-49 (May 6, 1997).

Anguera, J. et al. "Miniature Wideband Stacked Microstrip Patch Antenna Based on the Sierpinski Fractal Geometry," IEEE Antennas and Propagation Society International Symposium, 2000 Digest. Aps., vol. 3 of 4, pp. 1700-1703 (Jul. 16, 2000).

Hara Prasad, R.V., et al., "Microstrip Fractal Patch Antenna for Multi-Band Communication," Electronics Letters, lEE Stevenage, GB, vol. 36, No. 14, pp. 1179-1180 (Jul. 6, 2000).

Borja, C. et al., "High Directive fractal Boundary Microstrip Patch Antenna," Electronics Letters, IEE Stevenage, GB, vol. 36, No. 9. pp. 778-779 (Apr. 27, 2000).

Sanad, Mohamed, "A Compact Dual-Broadband Microstrip Antenna Having Both Stacked and Planar Parasitic Elements," IEEE Antennas and Propagation Society International Symposium 1996 Digest, Jul. 21-26, 1996, pp. 6-9.

MULTIBAND ANTENNA

This patent application is a continuation of U.S. patent application Ser. No. 11/702,791, filed on Feb. 6, 2007 now U.S. Pat. No. 7,439,923. U.S. patent application Ser. No. 11/702,791 is a continuation of U.S. patent application Ser. No. 10/823,257, filed on Apr. 13, 2004 now U.S. Pat. No. 7,215,287. U.S. patent application Ser. No. 10/823,257 is a continuation of PCT/EP01/011912, filed on Oct. 16, 2001. U.S. patent application Ser. No. 11/702,791, U.S. patent application Ser. No. 10/823,257, and International Application No. PCT/EP01/011912 are incorporated herein by reference.

OBJECT AND BACKGROUND OF THE INVENTION

The present invention relates generally to a new family of antennas with a multiband behaviour. The general configuration of the antenna consists of a multilevel structure which provides the multiband behaviour. A description on Multilevel Antennas can be found in Patent Publication No. WO01/22528. In the present invention, a modification of said multilevel structure is introduced such that the frequency bands of the antenna can be tuned simultaneously to the main existing wireless services. In particular, the modification consists of shaping at least one of the gaps between some of the polygons in the form of a non-straight curve.

Several configurations for the shape of said non-straight curve are allowed within the scope of the present invention. Meander lines, random curves or space-filling curves, to name some particular cases, provide effective means for conforming the antenna behaviour. A thorough description of Space-Filling curves and antennas is disclosed in patent "Space-Filling Miniature Antennas" (Patent Publication No. WO01/54225).

Although patent publications WO01/22528 and WO01/54225 disclose some general configurations for multiband and miniature antennas, an improvement in terms of size, bandwidth and efficiency is obtained in some applications when said multilevel antennas are set according to the present invention. Such an improvement is achieved mainly due to the combination of the multilevel structure in conjunction of the shaping of the gap between at least a couple of polygons on the multilevel structure. In some embodiments, the antenna is loaded with some capacitive elements to finely tune the antenna frequency response.

In some particular embodiments of the present invention, the antenna is tuned to operate simultaneously at five bands, those bands being for instance GSM900 (or AMPS), GSM1800, PCS1900, UMTS, and the 2.4 GHz band for services such as for instance Bluetooth™. IEEE802.11b and HiperLAN. There is in the prior art one example of a multilevel antenna which covers four of said services, see embodiment (3) in FIG. 1, but there is not an example of a design which is able to integrate all five bands corresponding to those services aforementioned into a single antenna.

The combination of said services into a single antenna device provides an advantage in terms of flexibility and functionality of current and future wireless devices. The resulting antenna covers the major current and future wireless services, opening this way a wide range of possibilities in the design of universal, multi-purpose, wireless terminals and devices that can transparently switch or simultaneously operate within all said services.

SUMMARY OF THE INVENTION

The key point of the present invention consists of combining a multilevel structure for a multiband antenna together with an especial design on the shape of the gap or spacing between two polygons of said multilevel structure. A multilevel structure for an antenna device consists of a conducting structure including a set of polygons, all of said polygons featuring the same number of sides, wherein said polygons are electromagnetically coupled either by means of a capacitive coupling or ohmic contact, wherein the contact region between directly connected polygons is narrower than 50% of the perimeter of said polygons in at least 75% of said polygons defining said conducting multilevel structure. In this definition of multilevel structures, circles and ellipses are included as well, since they can be understood as polygons with a very large (ideally infinite) number of sides.

Some particular examples of prior-art multilevel structures for antennas are found in FIG. 1. A thorough description on the shapes and features of multilevel antennas is disclosed in patent publication WO01/22528. For the particular case of multilevel structure described in drawing (3), FIG. 1 and in FIG. 2, an analysis and description on the antenna behaviour is found in (J. Ollikainen, O Kivekäs, A. Toropainen, P. Vainikainen, "Internal Dual-Band Patch Antenna for Mobile Phones", APS-2000 Millennium Conference on Antennas and Propagation, Davos, Switzerland, April 2000).

When the multiband behaviour of a multilevel structure is to be packed in a small antenna device, the spacing between the polygons of said multilevel structure is minimized. Drawings (3) and (4) in FIG. 1 are some examples of multilevel structures where the spacing between conducting polygons (rectangles and squares in these particular cases) take the form of straight, narrow gaps.

In the present invention, at least one of said gaps is shaped in such a way that the whole gap length is increased yet keeping its size and the same overall antenna size. Such a configuration allows an effective tuning of the frequency bands of the antenna, such that with the same overall antenna size, said antenna can be effectively tuned simultaneously to some specific services, such as for instance the five frequency bands that cover the services AMPS, GSM900, GSM1800, PCS1900, UMTS, Bluetooth™, IEEE802.11b or HyperLAN.

FIGS. 3 to 7 show some examples of how the gap of the antenna can be effectively shaped according to the present invention. For instance, gaps (109), (110), (112), (113), (114), (116), (118), (120), (130), (131), and (132) are examples of non-straight gaps that take the form of a curved or branched line. All of them have in common that the resonant length of the multilevel structure is changed, changing this way the frequency behaviour of the antenna. Multiple configurations can be chosen for shaping the gap according to the present invention:

a) A meandering curve.
b) A periodic curve.
c) A branching curve, with a main longer curve with one or more added segments or branching curves departing from a point of said main longer curve.
d) An arbitrary curve with 2 to 9 segments.
e) An space-filling curve.

An Space-Filling Curve (hereafter SFC) is a curve that is large in terms of physical length but small in terms of the area in which the curve can be included. More precisely, the following definition is taken in this document for a space-filling curve: a curve composed by at least ten segments which are connected in such a way that each segment forms an angle with their neighbours, that is, no pair of adjacent segments define a larger straight segment, and wherein the curve can be optionally periodic along a fixed straight direction of space if, and only if, the period is defined by a non-periodic curve composed by at least ten connected segments and no pair of said adjacent and connected segments defines a straight longer segment. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the gap according to the present invention, the segments of the SFC curves included in said multilevel structure must be shorter than a tenth of the free-space operating wavelength.

It is interesting noticing that, even though ideal fractal curves are mathematical abstractions and cannot be physically implemented into a real device, some particular cases of SFC can be used to approach fractal shapes and curves, and therefore can be used as well according to the scope and spirit of the present invention.

The advantages of the antenna design disclosed in the present invention are:

(a) The antenna size is reduced with respect to other prior-art multilevel antennas.

(b) The frequency response of the antenna can be tuned to five frequency bands that cover the main current and future wireless services (among AMPS, GSM900, GSM1800, PCS1900, Bluetooth™, IEEE802.11b and HiperLAN).

Those skilled in the art will notice that current invention can be applied or combined to many existing prior-art antenna techniques. The new geometry can be, for instance, applied to microstrip patch antennas, to Planar Inverted-F antennas (PIFAs), to monopole antennas and so on. FIGS. 6 and 7 describe some patch of PIFA like configurations. It is also clear that the same antenna geometry can be combined with several ground-planes and radomes to find applications in different environments: handsets, cellular phones and general hand-held devices; portable computers (Palmtops, PDA, Laptops, . . . ), indoor antennas (WLAN, cellular indoor coverage), outdoor antennas for microcells in cellular environments, antennas for cars integrated in rear-view mirrors, stop-lights, bumpers and so on.

In particular, the present invention can be combined with the new generation of ground-planes described in the PCT application entitled "Multilevel and Space-Filling Ground-planes for Miniature and Multiband Antennas", which describes a ground-plane for an antenna device, comprising at least two conducting surfaces, said conducting surfaces being connected by at least a conducting strip, said strip being narrower than the width of any of said two conducting surfaces.

When combined to said ground-planes, the combined advantages of both inventions are obtained: a compact-size antenna device with an enhanced bandwidth, frequency behaviour, VSWR, and efficiency.

DETAILED DESCRIPTION OF THE PREFERRED EMBODIMENTS

Figure 1:
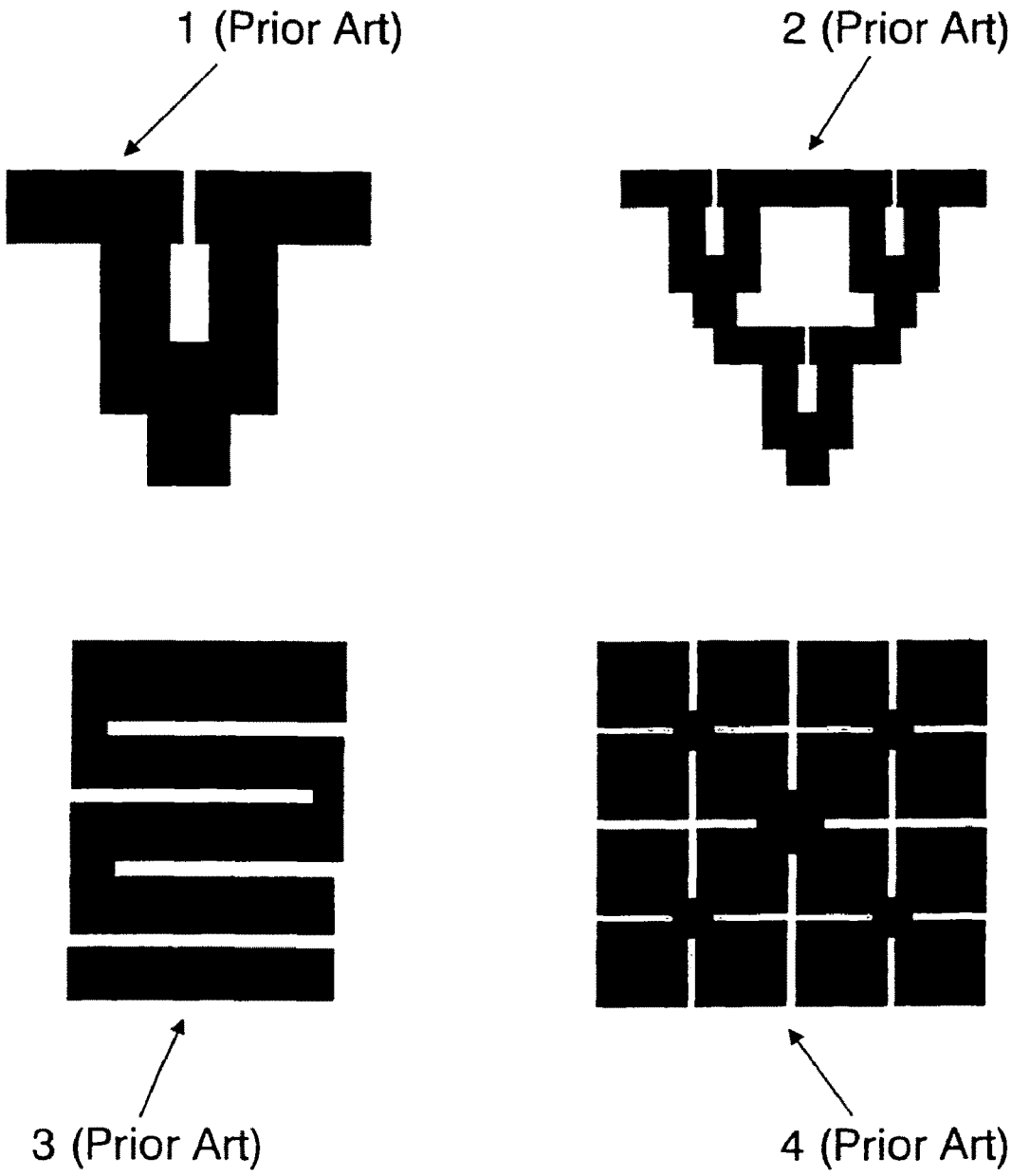
FIG. 1 describes four particular examples (1), (2), (3), (4) of prior-art multilevel geometries for multilevel antennas.
Figure 2:
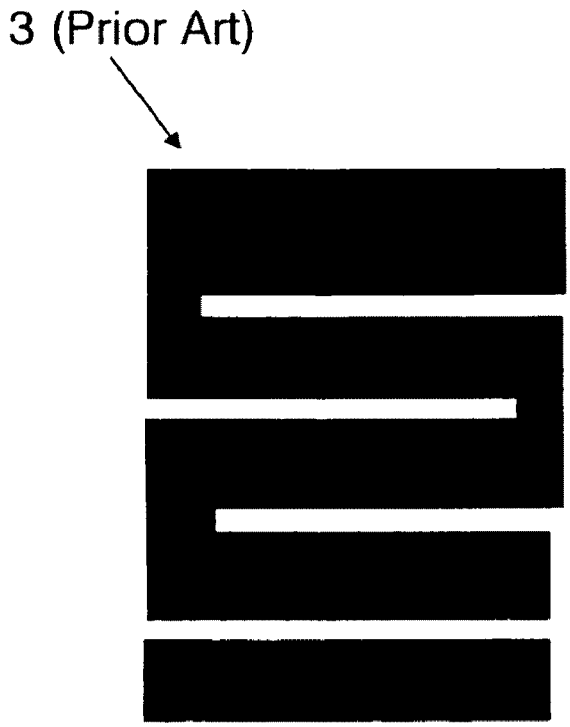
FIG. 2 describes a particular case of a prior-art multilevel antenna formed with eight rectangles (101), (102), (103), (104), (105), (106), (107), and (108).
Figure 2:
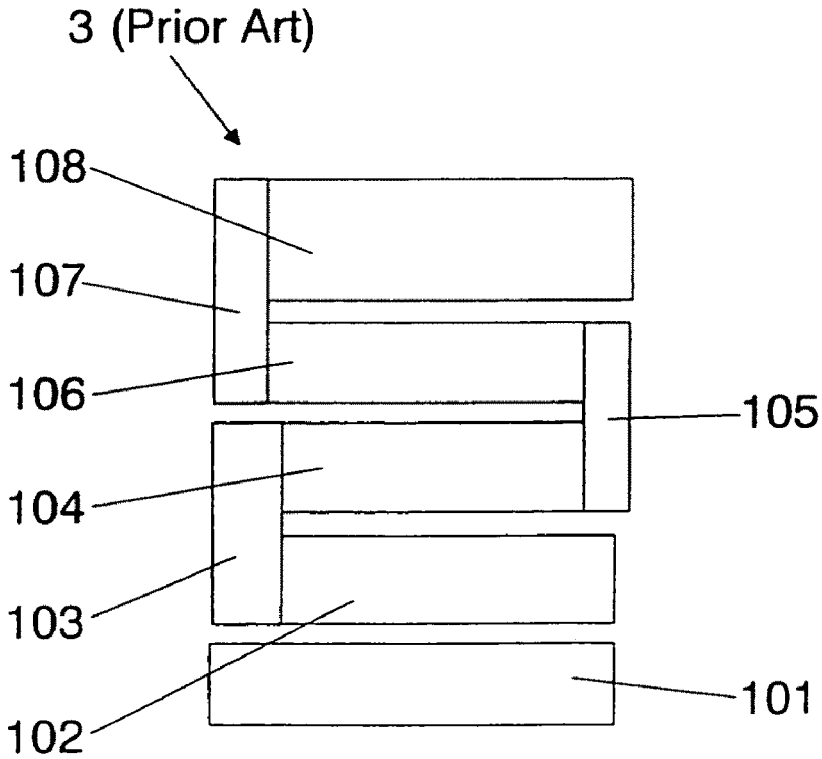
Figure 3:
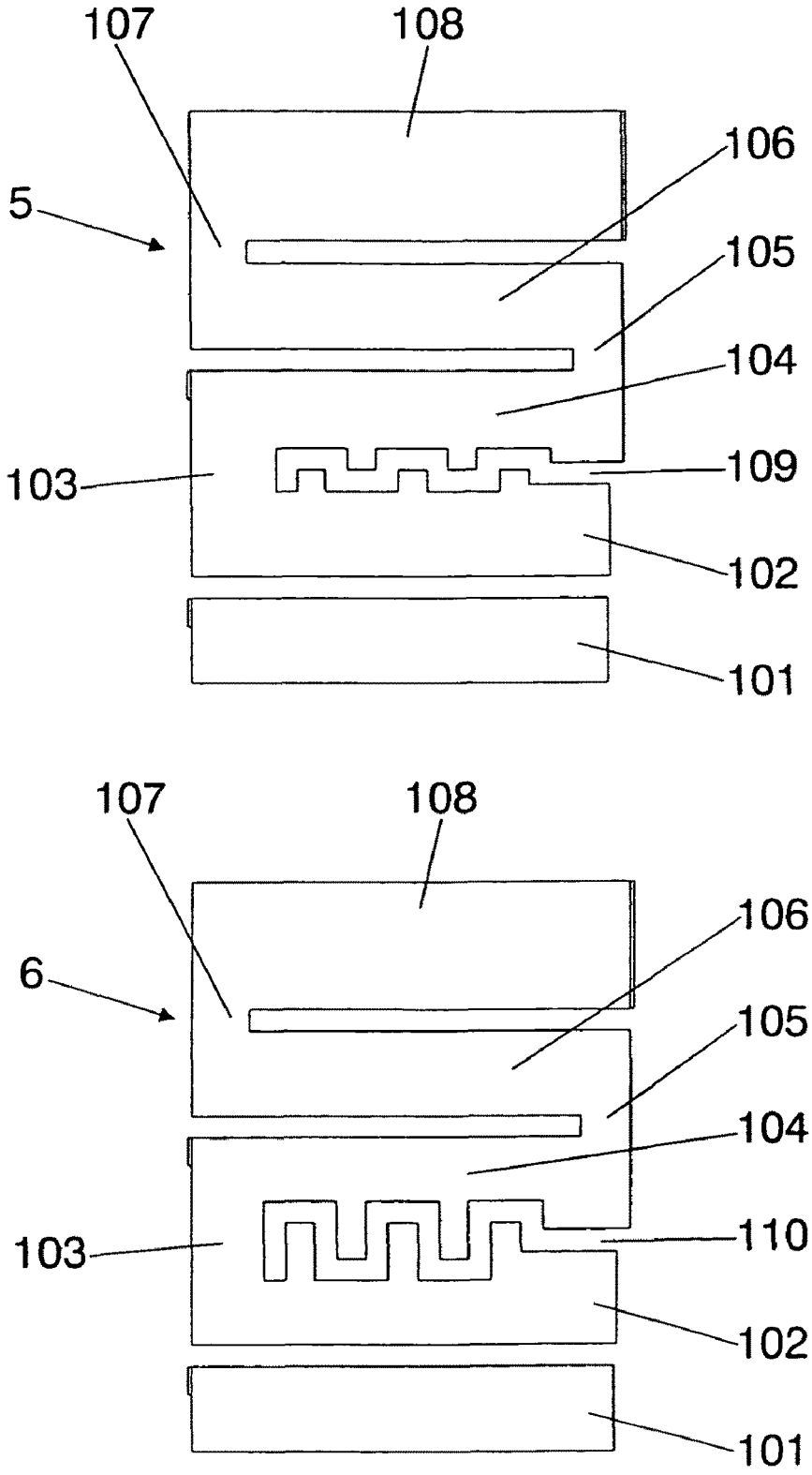
FIG. 3 drawings (5) and (6) show two embodiments of the present invention. Gaps (109) and (110) between rectangles (102) and (104) of design (3) are shaped as non-straight curves (109) according to the present invention.

Drawings (5) and (6) in FIG. 3 show two particular embodiments of the multilevel structure and the non-linear gap according to the present invention. The multilevel structure is based on design (3) in FIG. 2 and it includes eight conducting rectangles: a first rectangle (101) being capacitively coupled to a second rectangle (102), said second rectangle being connected at one tip to a first tip of a third rectangle (103), said third rectangle being substantially orthogonal to said second rectangle, said third rectangle being connected at a second tip to a first tip of a fourth rectangle (104), said fourth rectangle being substantially orthogonal to said third rectangle and substantially parallel to said second rectangle, said fourth rectangle being connected at a second tip to a first tip of a fifth rectangle (105), said fifth rectangle being substantially orthogonal to said fourth rectangle and substantially parallel to said third rectangle, said fifth rectangle being connected at a second tip to a first tip of a sixth rectangle (106), said sixth rectangle being substantially orthogonal to said fifth rectangle and substantially parallel to said fourth rectangle, said sixth rectangle being connected at a second tip to a first tip of a seventh rectangle (107), said seventh rectangle being substantially orthogonal to said sixth rectangle and parallel to said fifth rectangle, said seventh rectangle being connected to a first tip of an eighth rectangle (108), said eighth rectangle being substantially orthogonal to said seventh rectangle and substantially parallel to said sixth rectangle.

Both designs (5) and (6) include a non-straight gap (109) and (110) respectively, between second (102) and fourth (104) polygons. It is clear that the shape of the gap and its physical length can be changed. This allows a fine tuning of the antenna to the desired frequency bands in case the conducting multilevel structure is supported by a high permittivity substrate.

The advantage of designs (5) and (6) with respect to prior art is that they cover five bands that include the major existing wireless and cellular systems (among AMPS, GSM900, GSM1800, PCS1900, UMTS, Bluetooth™, IEEE802.11b, HiperLAN).

Figure 4:
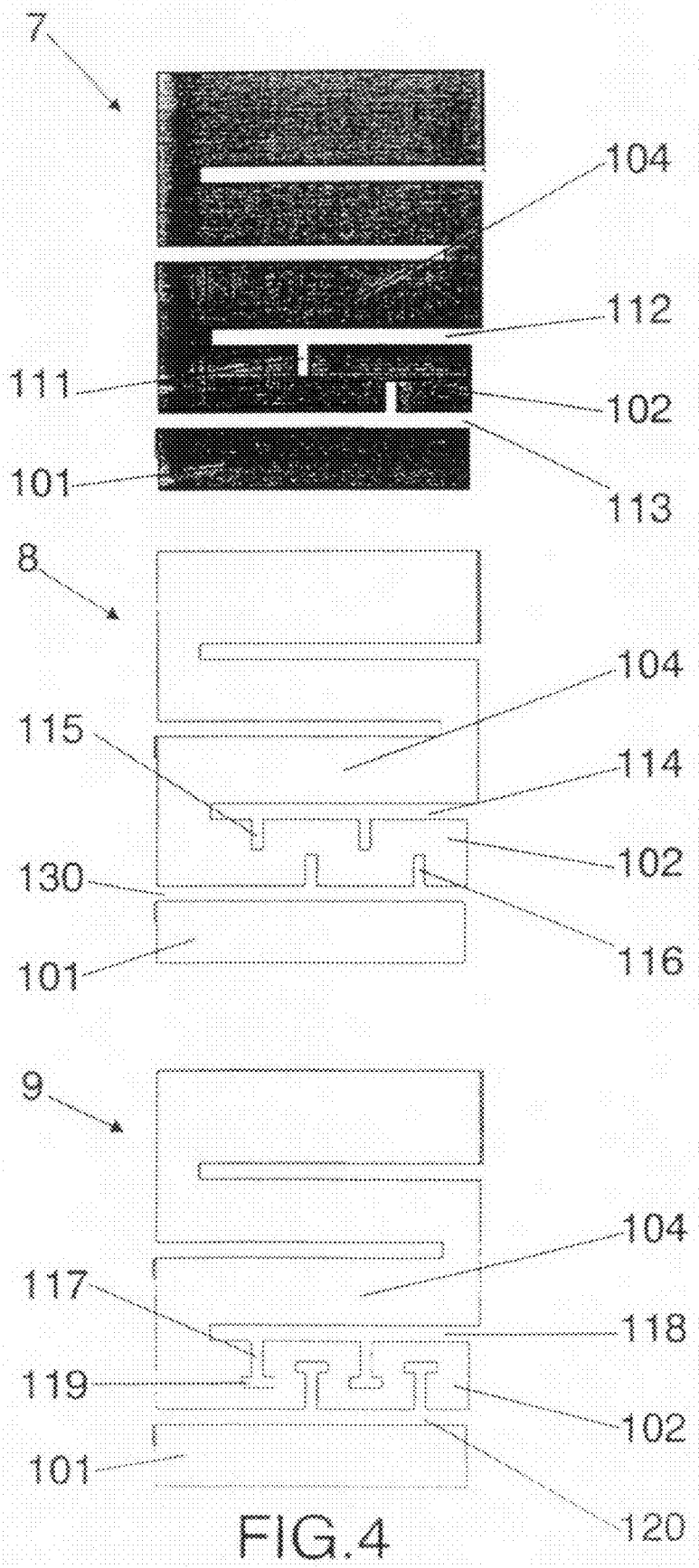
FIG. 4 shows three examples of embodiments (7), (8), (9) for the present invention. All three have in common that include branching gaps (112), (113), (114), (130), (118), (120).

Three other embodiments for the invention are shown in FIG. 4. All three are based on design (3) but they include two shaped gaps. These two gaps are placed between rectangle (101) and rectangle (102), and between rectangle (102) and (104) respectively. In these examples, the gaps take the form of a branching structure. In embodiment (7) gaps (112) and (113) include a main gap segment plus a minor gap-segment (111) connected to a point of said main gap segment. In embodiment (8), gaps (114) and (116) include respectively two minor gap-segments such as (115). Many other branching structures can be chosen for said gaps according to the present invention, and for instance more convoluted shapes for the minor gaps as for instance (117) and (119) included in gaps (118) and (120) in embodiment (9) are possible within the scope and spirit of the present invention.

Figure 5:
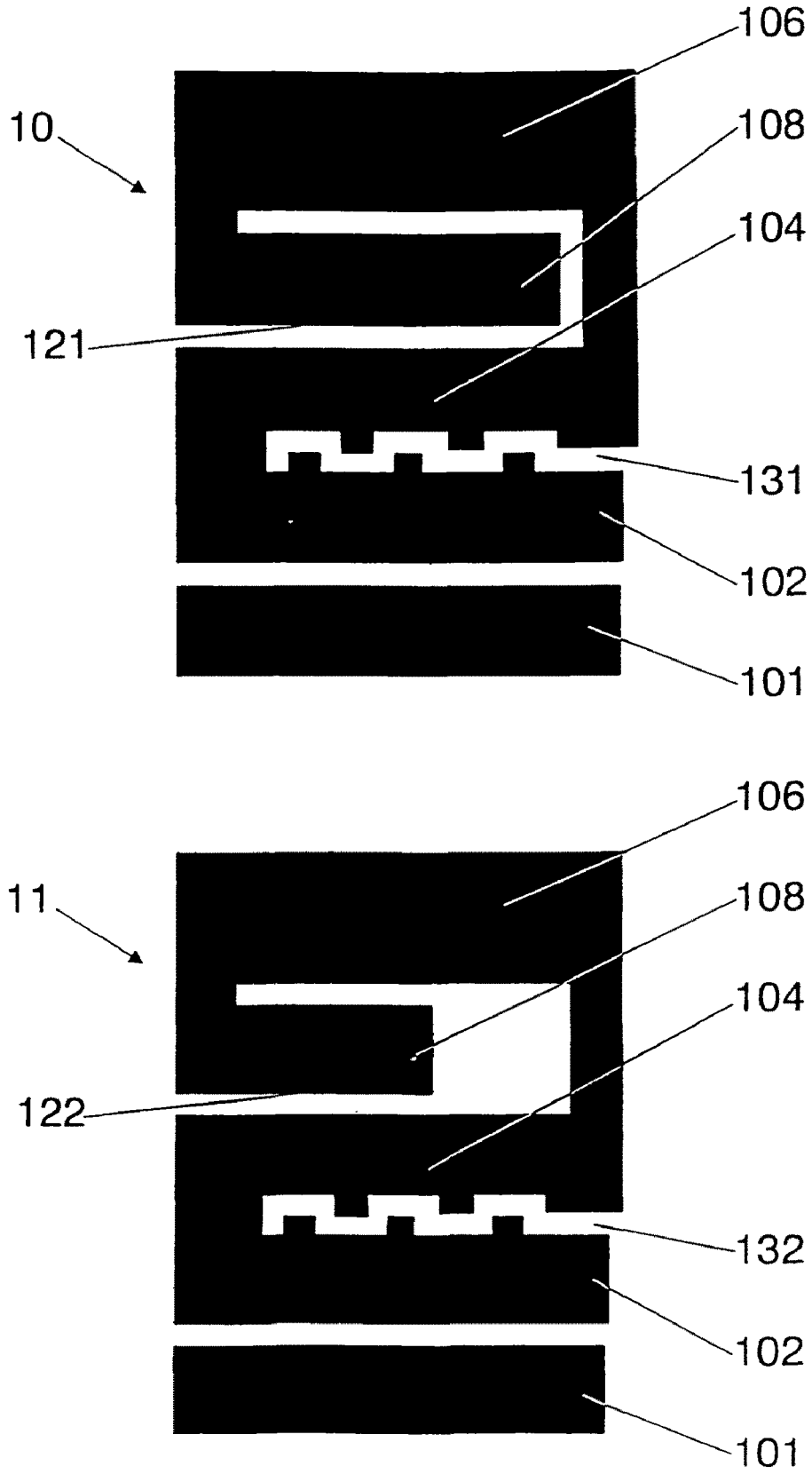
FIG. 5 shows two particular embodiments (10) and (11) for the present invention. The multilevel structure consists of a set of eight rectangles as in the case of design (3), but rectangle (108) is placed between rectangle (104) and (106). Non-straight, shaped gaps (131) and (132) are placed between polygons (102) and (104).

Although design in FIG. 3 has been taken as an example for embodiments in FIGS. 3 and 4, other eight-rectangle multilevel structures, or even other multilevel structures with a different number of polygons can be used according to the present invention, as long as at least one of the gaps between two polygons is shaped as a non-straight curve. Another example of an eight-rectangle multilevel structure is shown in embodiments (10) and (11) in FIG. 5. In this case, rectangle (108) is placed between rectangles (106) and (104) respectively. This contributes in reducing the overall antenna size with respect to design (3). Length of rectangle (108) can be adjusted to finely tune the frequency response of the antenna (different lengths are shown as an example in designs (10) and (11)) which is useful when adjusting the position of some of the frequency bands for future wireless services, or for instance to compensate the effective dielectric permittivity when the structure is built upon a dielectric surface.

Figure 6:
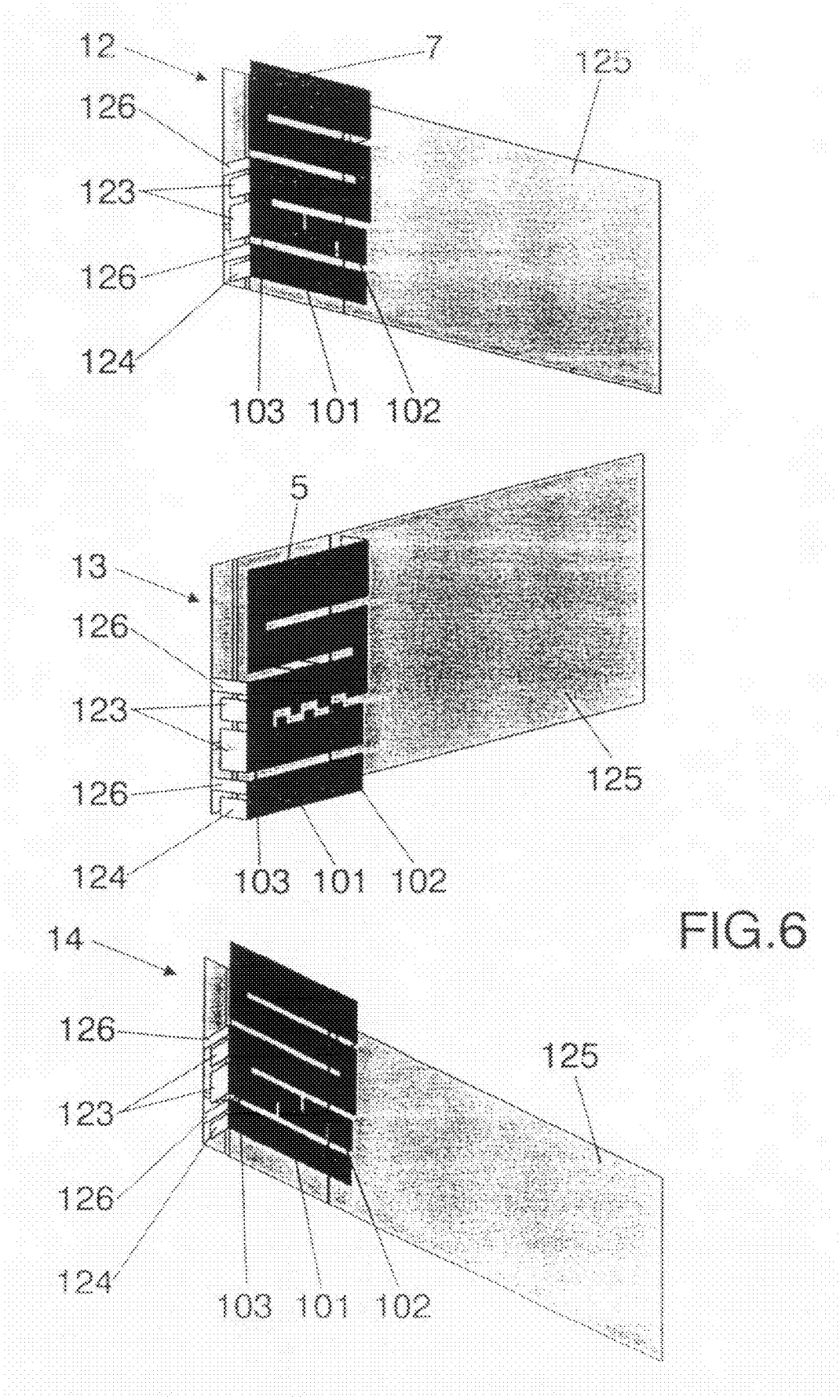
FIG. 6 shows three particular embodiments (12), (13), (14) for three complete antenna devices based on the combined multilevel and gap-shaped structure disclosed in the present invention. All three are mounted in a rectangular ground-plane such that the whole antenna device can be, for instance, integrated in a handheld or cellular phone. All three include two-loading capacitors (123) and (124) in rectangle (103), and a loading capacitor (124) in rectangle (101). All of them include two short-circuits (126) on polygons (101) and (103) and are fed by means of a pin or coaxial probe in rectangles (102) or (103).

FIG. 6 shows three examples of embodiments (12), (13), and (14) where the multilevel structure is mounted in a particular configuration as a patch antenna. Designs (5) and (7) are chosen as a particular example, but it is obvious that any other multilevel structure can be used in the same manner as well, as for instance in the case of embodiment (14). For the embodiments in FIG. 6, a rectangular ground-plane (125) is included and the antenna is placed at one end of said ground-plane. These embodiments are suitable, for instance, for handheld devices and cellular phones, where additional space is required for batteries and circuitry. The skilled in the art will notice, however, that other ground-plane geometries and positions for the multilevel structure could be chosen, depending on the application (handsets, cellular phones and general handheld devices; portable computers such as Palmtops, PDA, Laptops, indoor antennas for WLAN, cellular indoor coverage, outdoor antennas for microcells in cellular environments, antennas for cars integrated in rear-view mirrors, stop-lights, and bumpers are some examples of possible applications) according to the present invention.

All three embodiments (12), (13), (14) include two-loading capacitors (123) and (124) in rectangle (103), and a loading capacitor (124) in rectangle (101). All of them include two short-circuits (126) on polygons (101) and (103) and are fed by means of a pin or coaxial probe in rectangles (102) or (103). Additionally, a loading capacitor at the end of rectangle (108) can be used for the tuning of the antenna.

It will be clear to those skilled in the art that the present invention can be combined in a novel way to other prior-art antenna configurations. For instance, the new generation of ground-planes disclosed in the PCT application entitled "Multilevel and Space-Filling Ground-planes for Miniature and Multiband Antennas" can be used in combination with the present invention to further enhance the antenna device in terms of size, VSWR, bandwidth, and/or efficiency. A particular case of ground-plane (125) formed with two conducting surfaces (127) and (129), said surfaces being connected by means of a conducting strip (128), is shown as an example in embodiment (15).

Figure 7:
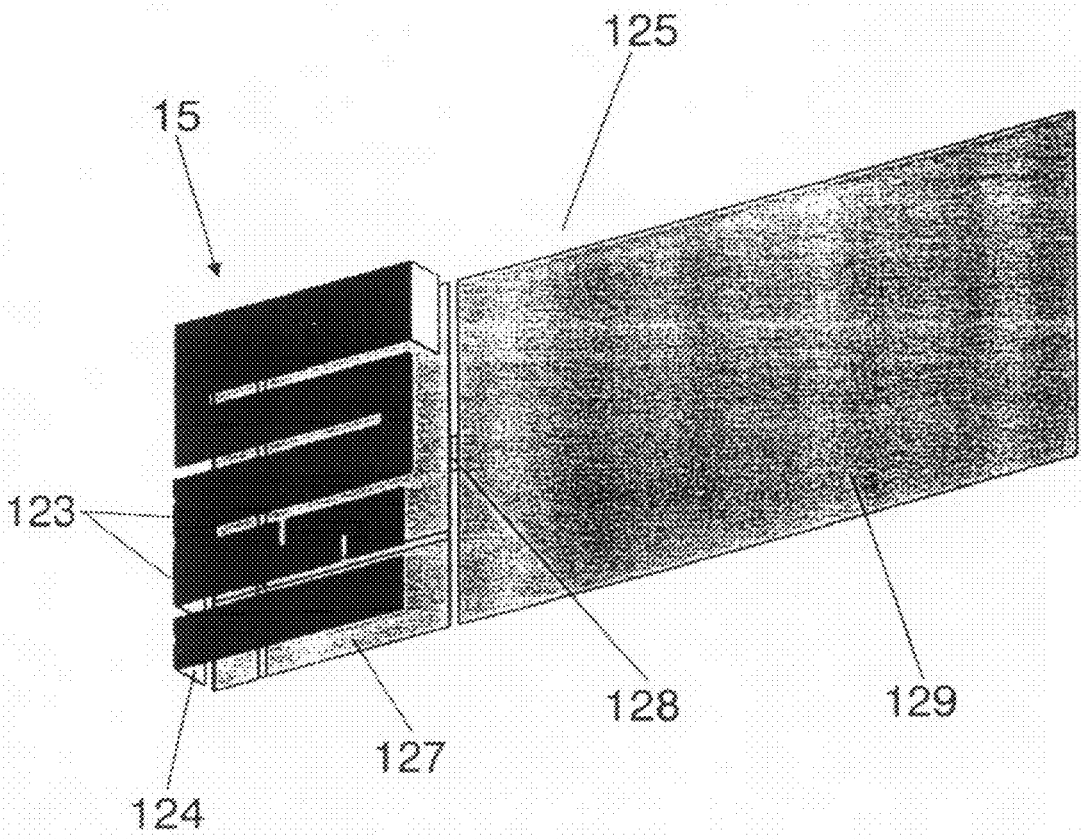
FIG. 7 shows a particular embodiment (15) of the invention combined with a particular case of Multilevel and Space-Filling ground-plane according to the PCT application entitled "Multilevel and Space-Filling Ground-planes for Miniature and Multiband Antennas". In this particular case, ground-plane (125) is formed by two conducting surfaces (127) and (129) with a conducting strip (128) between said two conducting surfaces.

The particular embodiments shown in FIGS. 6 and 7 are similar to PIFA configurations in the sense that they include a shorting-plate or pin for a patch antenna upon a parallel ground-plane. The skilled in the art will notice that the same multilevel structure including the non-straight gap can be used in the radiating elements of other possible configurations, such as for instance, monopoles, dipoles or slotted structures.

It is important to stress that the key aspect of the invention is the geometry disclosed in the present invention. The manufacturing process or material for the antenna device is not a relevant part of the invention and any process or material described in the prior-art can be used within the scope and spirit of the present invention. To name some possible examples, but not limited to them, the antenna could be stamped in a metal foil or laminate; even the whole antenna structure including the multilevel structure, loading elements and ground-plane could be stamped, etched or laser cut in a single metallic surface and folded over the short-circuits to obtain, for instance, the configurations in FIGS. 6 and 7. Also, for instance, the multilevel structure might be printed over a dielectric material (for instance FR4, Rogers®, Arlon® or Cuclad®) using conventional printing circuit techniques, or could even be deposited over a dielectric support using a two-shot injecting process to shape both the dielectric support and the conducting multilevel structure.

What is claimed:

1. A handheld wireless device comprising:

a printed circuit board comprising a ground plane;

communication circuitry on the printed circuit board;

antenna feeding means coupled to the communications circuitry;

a battery coupled to the communication circuitry;

an antenna connected to the antenna feeding means and comprising a multilevel conducting structure, substantial portions of the multilevel structure being formed of a plurality of polygons;

wherein the plurality of polygons comprise geometric elements identifiably defined by a free perimeter thereof and a projection of the longest exposed perimeter thereof to define the least number of generally identifiable polygons within a region;

wherein at least two polygons of the plurality of polygons are coupled by a conducting strip narrower in width than any one of the at least two polygons; and wherein at least two polygons of the plurality of polygons are separated by a non-straight gap contributing to tuning a frequency behavior of the antenna.

2. The handheld device of claim 1, wherein the at least two separated polygons are coupled via ohmic contact.

3. The handheld device of claim 1, wherein the at least two separated polygons are coupled via capacitive coupling.

4. The handheld wireless device of claim 1, comprising:

a dielectric support; and wherein the antenna is mounted on the dielectric support.

5. The handheld wireless device of claim 4, wherein the dielectric support comprises high permittivity material.

6. The handheld wireless device of claim 1, wherein the handheld wireless device operates as a cellular phone.

7. The handheld wireless device of claim 1, wherein the handheld wireless device operates as a portable computer.

8. The handheld wireless device of claim 7, wherein the portable computer is selected from the group consisting of palmtops, personal digital assistants, and laptops.

9. The handheld wireless device of claim 1, wherein the handheld wireless device operates as a handset.

10. The handheld wireless device of claim 1, wherein the handheld wireless device operates on four frequency bands.

11. The handheld wireless device of claim 1, wherein:

the handheld wireless device is operative at multiple frequency bands; and at least one of the multiple frequency bands is used by a GSM or UMTS communication service.

12. The handheld wireless device of claim 1, wherein:

the handheld wireless device is operative at multiple frequency bands;

a first one of said multiple frequency bands is used by a GSM communication service and a second one of said multiple frequency bands is used by a UMTS communication service.

13. The handheld wireless device of claim 1, wherein the handheld wireless device is operative at least at four frequency bands.

14. The handheld wireless device of claim 1, wherein the handheld wireless device is operative at least at five frequency bands.

15. The handheld wireless device of claim 1, wherein the handheld wireless device is operative according to at least three of AMPS, GSM900, GSM1800, PCS1900, and UMTS.

16. The handheld wireless device of claim 1, wherein the handheld wireless device is operative according to at least four of AMPS, GSM900, GSM1800, PCS1900, and UMTS.

17. The handheld wireless device of claim 1, wherein the handheld wireless device is operative according to at least five of AMPS, GSM850, GSM900, GSM1800, PCS1900, and UMTS.

18. The handheld wireless device of claim 1, wherein the handheld wireless device is operative according to at least one of BLUETOOTH, IEEE 802.11, and HiperLAN.

19. The handheld wireless device of claim 1, wherein the handheld wireless device is operative according to at least two of BLUETOOTH, IEEE 802.11, and HiperLAN.

20. The handheld wireless device of claim 1, wherein the antenna is a microstrip patch antenna.

21. The handheld wireless device of claim 1, wherein the antenna is a planar inverted-F antenna.

22. The handheld wireless device of claim 1, wherein the antenna is a monopole antenna.

23. The handheld wireless device of claim 1, wherein the non-straight gap comprises a meandering curve.

24. The handheld wireless device of claim 1, wherein the non-straight gap comprises a periodic curve.

25. The handheld wireless device of claim 1, wherein the non-straight gap comprises a branching curve.

26. The handheld wireless device of claim 1, wherein the non-straight gap comprises an arbitrary curve of 2-9 segments.

27. The handheld wireless device of claim 1, wherein the non-straight gap comprises a space-filling curve.

28. The handheld wireless device of claim 1, wherein:

the non-straight gap comprises a branching curve; and at least one branch of the non-straight gap comprises a branch emanating therefrom.

29. The handheld wireless device of claim 1, wherein the emanating branch is narrower in width than the branch from which the emanating branch emanates.

30. The handheld wireless device of claim 1, wherein at least two branches of the non-straight gap comprise a branch emanating therefrom.

31. The handheld wireless device of claim 1, wherein the non-straight gap has a non-constant width.

32. The handheld wireless device of claim 1, wherein the multilevel conducting structure comprises a second non-straight gap separating at least two polygons of the plurality of polygons.

33. The handheld wireless device of claim 32, wherein at least one of the non-straight gap and the second non-straight gap comprises a branching curve.

34. The handheld wireless device of claim 33, wherein non-branched portions of the non-straight gap and the second non-straight gap are in a direction parallel to one another.

35. The handheld wireless device of claim 34, wherein no branch of the non-straight gap is directly opposite a branch of the second non-straight gap in a direction perpendicular to the direction of the non-branched portions.

36. The handheld wireless device of claim 32, wherein each of the non-straight gap and the second non-straight gap comprises a branching structure.

37. The handheld wireless device of claim 1, wherein at least one of the branching structures comprises a branch of a branch.

38. The handheld wireless device of claim 1, wherein:

the non-straight gap comprises a branching curve; and at least one branch of the non-straight gap comprises a T shape.

39. The handheld wireless device of claim 1, wherein:

the non-straight gap comprises a branching curve; and at least one branch of the non-straight gap is at a right angle to a segment of the branching curve from which the at least one branch emanates.

40. The handheld wireless device of claim 1, wherein the non-straight gap comprises a plurality of segments, and wherein at least two segments of the plurality of segments have different lengths.

41. The handheld wireless device of claim 1, wherein the multilevel conducting structure comprises a parasitic element.

42. The handheld wireless device of claim 41, wherein the parasitic element is polygonal in shape.

43. The handheld wireless device of claim 41, wherein the non-straight gap is defined in part by the parasitic element.

44. The handheld wireless device of claim 1, wherein the antenna is positioned adjacent an end of the ground plane.

45. The handheld wireless device of claim 44, wherein the antenna is spaced apart from the ground plane in a direction perpendicular to the ground plane.

46. The handheld wireless device of claim 45, wherein the antenna and the ground plane are parallel to one another.

47. The handheld wireless device of claim 1, wherein the ground plane comprises two conducting portions ohmically coupled by a conducting strip.

48. The handheld wireless device of claim 47, wherein a projection of the antenna perpendicular to the ground plane does not intersect the conducting strip of the ground plane.

49. The handheld wireless device of claim 48, wherein a projection of the antenna perpendicular to the ground plane is adjacent to the conducting strip of the ground plane.

50. The handheld wireless device of claim 1, wherein the ground plane comprises a slot at an edge thereof.

* * * * *